US009737163B2

(12) United States Patent
Rykena

(10) Patent No.: US 9,737,163 B2
(45) Date of Patent: Aug. 22, 2017

(54) SHOE CHANGING SUPPORT ASSEMBLY

(71) Applicant: Donald Robert Rykena, Brooklyn, OH (US)

(72) Inventor: Donald Robert Rykena, Brooklyn, OH (US)

(73) Assignee: Donald Robert Rykena, Brooklyn, OH (US)

( * ) Notice: Subject to any disclaimer, the term of this patent is extended or adjusted under 35 U.S.C. 154(b) by 0 days.

(21) Appl. No.: 14/963,182

(22) Filed: Dec. 8, 2015

(65) Prior Publication Data

US 2016/0157652 A1 Jun. 9, 2016

Related U.S. Application Data

(60) Provisional application No. 62/124,037, filed on Dec. 8, 2014.

(51) Int. Cl.
*A47G 25/80* (2006.01)

(52) U.S. Cl.
CPC ..... *A47G 25/80* (2013.01)

(58) Field of Classification Search
CPC ..... A47G 25/80; A47G 25/84
USPC ..... 223/114, 115–117
See application file for complete search history.

(56) References Cited

U.S. PATENT DOCUMENTS 3,490,661 A * 1/1970 Williams ..... A47G 25/80 223/114
3,623,640 A * 11/1971 Zalejski ..... A47G 25/80 223/114
3,964,117 A * 6/1976 Fox ..... A47G 25/80 12/120.5
4,262,828 A * 4/1981 Kosakai ..... A47G 25/80 223/115
4,978,043 A * 12/1990 Uke ..... A47G 25/16 211/113
6,135,331 A * 10/2000 Davis ..... A47G 25/80 223/111
6,702,163 B1 * 3/2004 Hopping ..... A47G 25/80 223/113
2009/0236377 A1 * 9/2009 Selvarajah ..... A47G 25/80 223/115
2010/0213222 A1 * 8/2010 Boyko ..... A47G 25/36 223/85

(Continued)

*Primary Examiner* — Nathan Durham
(74) *Attorney, Agent, or Firm* — Cooper Legal Group, LLC

(57) ABSTRACT

A shoe changing support assembly includes a body portion defining a support surface. The shoe changing support assembly defines a shoe removal opening along a perimeter edge of the body portion. The body portion receives a portion of a shoe within the shoe removal opening to facilitate shoe removal. A support portion is coupled to the body portion and includes a first lateral support structure extending along a first axis. A second lateral support structure is spaced a distance apart from the first lateral support structure and extending along a second axis. A transverse support structure extends along a transverse axis that is substantially perpendicular to the first axis and the second axis. The transverse support structure extends between the first lateral support structure and the second lateral support structure. The transverse support structure is coupled to the first lateral support structure and the second lateral support structure.

20 Claims, 5 Drawing Sheets

(56) References Cited

U.S. PATENT DOCUMENTS

| | | | | |
|---|---|---|---|---|
| 2011/0089203 | A1* | 4/2011 | McNair | A47G 25/86<br>223/114 |
| 2015/0305536 | A1* | 10/2015 | Link | A47G 25/86<br>223/114 |

* cited by examiner

SHOE CHANGING SUPPORT ASSEMBLY

CROSS-REFERENCE TO RELATED APPLICATIONS

This application claims priority to U.S. Provisional Application No. 62/124,037, titled "THE BOOT BOARD" and filed on Dec. 8, 2014, the entire disclosure of which is hereby incorporated by reference.

TECHNICAL FIELD

The instant application is directed towards a shoe changing support assembly for assisting a user in removing his or her shoes.

BACKGROUND

When a user has dirty or wet shoes, it may be beneficial to reduce the dirt/liquid from being tracked in a house. For example, the dirt/liquid from the shoes can be contained in a certain location to reduce tracking and to reduce the likelihood of a user stepping in the dirt/liquid. It may be desired to keep dirt/mud/liquid out of a vehicle after an outdoor activity, such as camping, hiking, hunting, fishing, outdoor exercise, etc. By keeping the dirt/mud/liquid out of the vehicle, the vehicle may remain clean and relatively scent-free.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, a shoe changing support assembly comprises a body portion defining a substantially planar support surface that is substantially parallel to a surface upon which the shoe changing support assembly is supported. The support surface is configured to support a user. The body portion defines a shoe removal opening defined along a perimeter edge of the body portion. The shoe removal opening is recessed towards a center of the body portion. The body portion is configured to receive a portion of a shoe within the shoe removal opening to facilitate shoe removal. A support portion is coupled to the body portion. The support portion comprises a first lateral support structure extending along a first axis. The support portion comprises a second lateral support structure spaced a distance apart from the first lateral support structure and extending along a second axis. The support portion comprises a transverse support structure extending along a transverse axis that is substantially perpendicular to the first axis and the second axis. The transverse support structure extends between the first lateral support structure and the second lateral support structure. The transverse support structure is coupled to the first lateral support structure and the second lateral support structure. The first lateral support structure, the second lateral support structure, and the transverse support structure are configured to be in contact with the surface upon which the shoe changing support assembly is supported.

In an example, a shoe changing support assembly comprises a body portion defining a substantially planar support surface that is substantially parallel to a surface upon which the shoe changing support assembly is supported. The support surface is configured to support a user. A shoe removal opening is defined along a perimeter edge of the body portion. The shoe removal opening is recessed towards a center of the body portion. The body portion is configured to receive a portion of a shoe within the shoe removal opening to facilitate shoe removal. A support portion is coupled to the body portion. The support portion comprises a first lateral support structure extending along a first axis adjacent to a first perimeter edge of the body portion. The support portion comprises a second lateral support structure spaced a distance apart from the first lateral support structure and extending along a second axis adjacent to a second perimeter edge of the body portion. The support portion comprises a transverse support structure extending along a transverse axis that is substantially perpendicular to the first axis and the second axis. The transverse support structure extends between the first lateral support structure and the second lateral support structure. The transverse support structure is coupled to the first lateral support structure and the second lateral support structure. The transverse support structure has a first width at a first location and a second width at a second location. The first width is different than the second width. The first lateral support structure, the second lateral support structure, and the transverse support structure are configured to be in contact with the surface upon which the shoe changing support assembly is supported.

In an example, a shoe changing support assembly comprises a body portion defining a substantially planar support surface that is substantially parallel to a surface upon which the shoe changing support assembly is supported. The support surface is configured to support a user. A shoe removal opening is defined along a perimeter edge of the body portion. The shoe removal opening is recessed towards a center of the body portion. The body portion is configured to receive a portion of a shoe within the shoe removal opening to facilitate shoe removal. A support portion is coupled to the body portion. The support portion comprises a first lateral support structure extending along a first axis adjacent to a first perimeter edge of the body portion. The support portion comprises a second lateral support structure spaced a distance apart from the first lateral support structure and extending along a second axis adjacent to a second perimeter edge of the body portion. The support portion comprises a transverse support structure extending along a transverse axis that is substantially perpendicular to the first axis and the second axis. The transverse support structure extends between the first lateral support structure and the second lateral support structure. The transverse support structure is coupled to the first lateral support structure and the second lateral support structure. The support portion comprises a second transverse support structure extending along a second transverse axis that is substantially parallel to the transverse axis. The second transverse support structure extends between the first lateral support structure and the second lateral support structure. The second transverse support structure is coupled to the first lateral support structure and the second lateral support structure. The first lateral support structure, the second lateral support structure, the transverse support structure, and the second transverse support structure are configured to be in contact with the surface upon which the shoe changing support assembly is supported.

The following description and annexed drawings set forth certain illustrative aspects and implementations. These are indicative of but a few of the various ways in which one or more aspects may be employed. Other aspects, advantages, and/or novel features of the disclosure will become apparent from the following detailed description when considered in conjunction with the annexed drawings.

DETAILED DESCRIPTION

Figure 1:
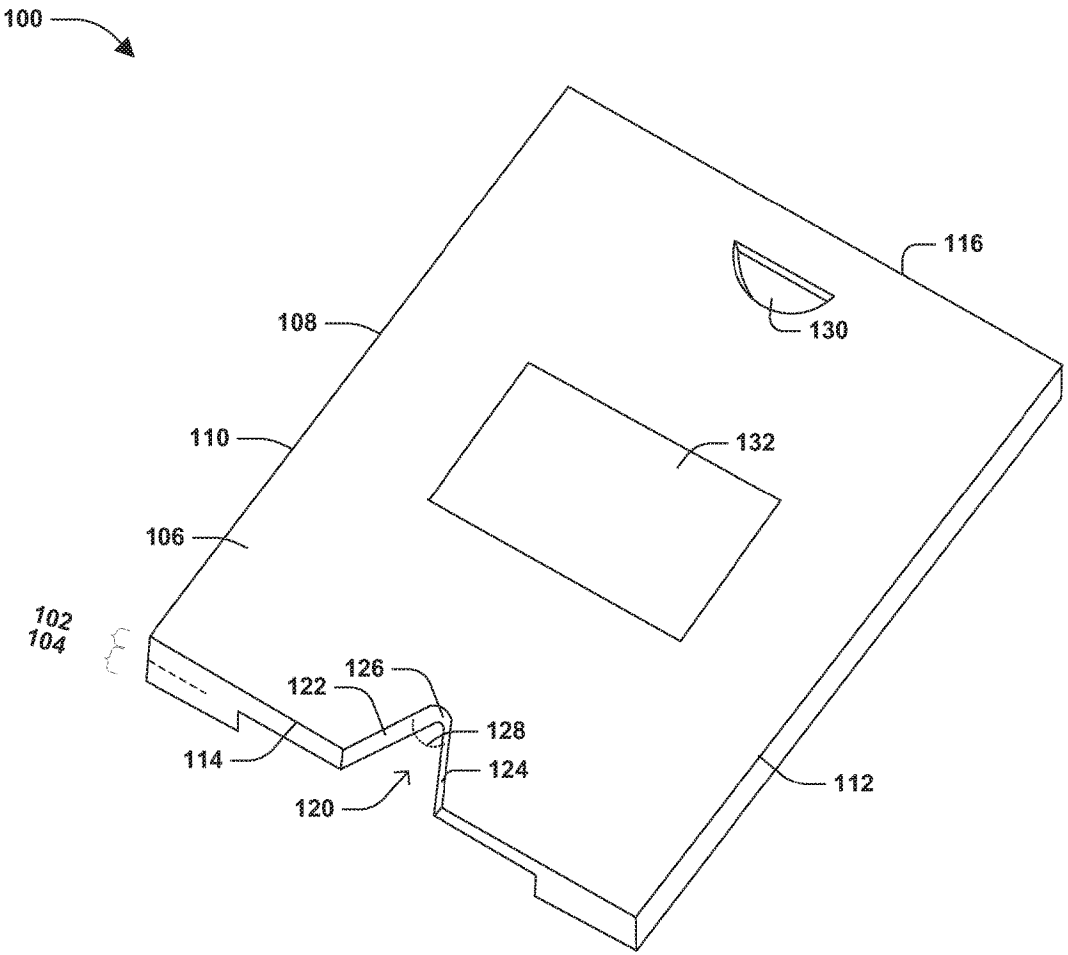
FIG. 1 is an illustration of a body portion of an example shoe changing support assembly.

The claimed subject matter is now described with reference to the drawings, wherein like reference numerals are used to refer to like elements throughout. In the following description, for purposes of explanation, numerous specific details are set forth in order to provide an understanding of the claimed subject matter. It is evident, however, that the claimed subject matter may be practiced without these specific details. In other instances, structures and devices are illustrated in block diagram form in order to facilitate describing the claimed subject matter. Relative size, orientation, etc. of parts, components, etc. may differ from that which is illustrated while not falling outside of the scope of the claimed subject matter.

Referring to FIG. 1, a shoe changing support assembly 100 is illustrated. The shoe changing support assembly 100 can assist a user in changing his or her shoes. It will be appreciated that the term "shoes" as used herein is not intended to be limiting. Rather, shoes may comprise boots, athletic shoes, cleats, fishing waders, and any type of footwear that can accumulate mud, dirt, etc. In an example, a user may have shoes that are dirty, muddy, wet, etc. Use of the shoe changing support assembly 100 can limit the spread of the dirt, mud, liquid and/or can reduce the likelihood of the user stepping in the dirt, mud, liquid in his or her socks. For example, the user can stand on the shoe changing support assembly 100 with a first foot while removing the shoe from a second foot. The user can then stand on the floor with the second foot while removing the shoe from the first foot. In this way, the dirt, mud, liquid, etc. can substantially be contained on the shoe changing support assembly 100 and not on the floor. The shoe changing support assembly 100 can support up to about 300 pounds of weight.

The shoe changing support assembly 100 comprises a body portion 102 and a support portion 104. The body portion 102 can define the portion of the shoe changing support assembly 100 that the user stands on. In an example, when the shoe changing support assembly 100 is supported on a surface (e.g., a floor, the ground, etc.), the body portion 102 defines an upper portion of the shoe changing support assembly 100 while the support portion 104 defines a lower portion of the shoe changing support assembly 100.

The body portion 102 defines a support surface 106 that is substantially planar and may be substantially parallel to a surface (e.g., a floor, the ground, etc.) upon which the shoe changing support assembly 100 is supported. The support surface 106 is defined at an upper side of the body portion 102, and can support a user. In the illustrated example, the support surface 106 is substantially flat and planar, though in other examples, the support surface 106 can comprise a non-planar surface. In some examples, the support surface 106 can have lettering, wording, images, numbers, marks, etc. engraved into, or placed upon the support surface 106. In an example, the support surface 106 can comprise a non-slip material (e.g., such as a non-slip texture surface that may have bumps, ridges, undulations, and/or a non-planar surface that increases a coefficient of friction) that reduces slippage, such as foam, rubber, or the like. This non-slip material (e.g., foam, rubber, etc.) can also be applied to a bottom of the shoe changing support assembly 100 such that the material can contact the floor, ground, etc. and reduce inadvertent slippage. As such, by providing the non-slip material along the upper support surface 106 and/or a bottom/underneath surface, the user is less likely to slip with respect to the shoe changing support assembly 100, and the shoe changing support assembly 100 is less likely to slip with respect to the ground/floor upon which the shoe changing support assembly 100 rests upon.

In an example, the support surface 106 can have a substantially rectangular shape, though other shapes (e.g., oval, circular, square, etc.) are envisioned. The support surface 106 can have an outer perimeter 108 that defines the substantially rectangular outer boundary of the support surface 106. In an example, the body portion 102 comprises one or more perimeter edges that together define the perimeter 108 of the support surface 106. For example, the body portion 102 may comprise a first perimeter edge 110, a second perimeter edge 112, a third perimeter edge 114, and a fourth perimeter edge 116. The first perimeter edge 110 and the second perimeter edge 112 may be substantially parallel to each other. The third perimeter edge 114 and the fourth perimeter edge 116 may be substantially parallel to each other and may be substantially perpendicular to the first perimeter edge 110 and the second perimeter edge 112.

The body portion 102 can define a shoe removal opening 120 that is defined along one of the perimeter edges (e.g., the first perimeter edge 110, the second perimeter edge 112, the third perimeter edge 114, and/or the fourth perimeter edge 116) of the body portion 102. In an example, the shoe removal opening 120 may be recessed towards a center of the body portion 102. That is, in this example, the shoe removal opening 120 can be recessed from third perimeter edge 114 towards the center of the body portion 102. It will be appreciated that the shoe removal opening 120 is not limited to being recessed from the third perimeter edge 114, and in other examples, can be recessed from the first perimeter edge 110, the second perimeter edge 112, and/or the fourth perimeter edge 116.

In an example, the shoe removal opening 120 can be defined by one or more sidewalls. In this example, the shoe removal opening 120 may be defined by a first sidewall 122 and a second sidewall 124. The first sidewall 122 may extend substantially linearly along an axis towards the center of the body portion 102. The second sidewall 124 may extend substantially linearly along an axis towards the center of the body portion 102. In this example, the first sidewall 122 and the second sidewall 124 can intersect to form a rounded intersection point 126. The rounded intersection point 126 is beneficial in that the intersection point 126 can contact a user's shoe and assist, along with the first sidewall 122 and the second sidewall 124, in helping to remove the user's shoe.

By being defined by the linearly extending first sidewall 122 and the second sidewall 124, the shoe removal opening 120 can have a triangular shape. In this example, the first sidewall 122 can have a length that substantially matches a length of the second sidewall 124. At the intersection point 126, the first sidewall 122 and the second sidewall 124 can form an angle 128 that is between about 0 degrees to about 90 degrees. In another example, the angle 128 is between about 20 degrees to about 70 degrees. In yet another example, the angle 128 is between about 30 degrees to about 60 degrees. In the illustrated example, the angle 128 is chosen to facilitate removal of the user's shoe. For example, the angle 128 may be chosen within a specified range, and the first sidewall 122 and the second sidewall 124 may be chosen to have a specified distance, such that the user's shoe (e.g., a rear/heel portion of the shoe) can be inserted into the shoe removal opening 120 and can fit between the first sidewall 122 and the second sidewall 124.

It will be appreciated that the body portion 102 is not limited to defining one shoe removal opening 120. Rather, in other examples, the body portion 102 may define a plurality of shoe removal openings 120. As such, the illustrated number and location of the shoe removal opening 120 in FIG. 1 is not intended to be limiting.

In an example, the body portion 102 may comprise a handle 130. The handle 130 defines an opening or recess extending through the body portion 102. The handle 130 can have a half circular shape, as illustrated, though other shapes are envisioned. The handle 130 may be positioned adjacent to the fourth perimeter edge 116 in this example. As such, the handle 130 may be positioned in closer proximity to the fourth perimeter edge 116 than the third perimeter edge 114. The handle 130 can allow for a user to hold and/or grip the shoe changing support assembly 100, so as to facilitate movement, transport, etc. In some examples, a space 132 can be provided for text, images, numbers, graphics, or the like.

Figure 2:
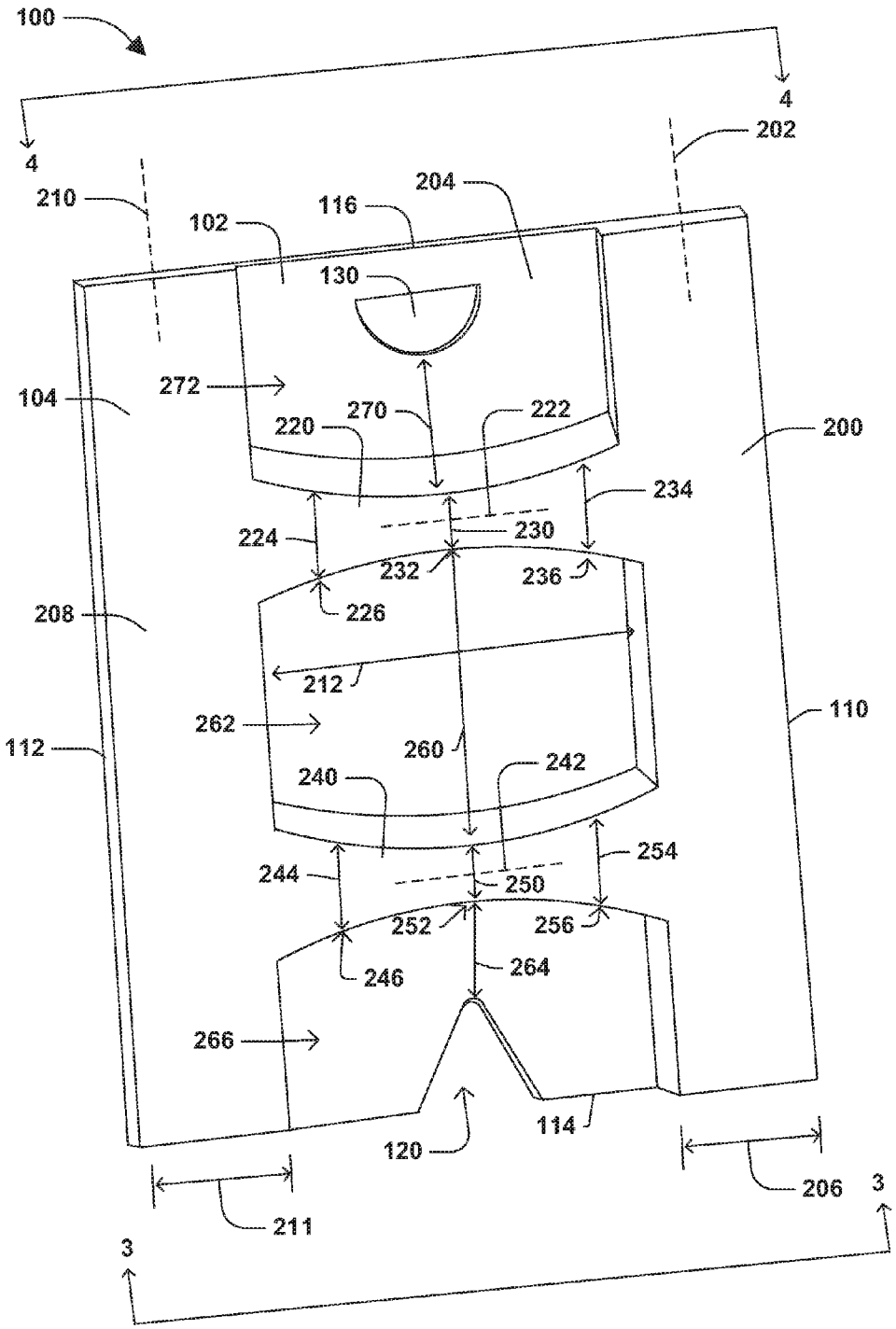
FIG. 2 is an illustration of a support portion of an example shoe changing support assembly.

Turning to FIG. 2, an underside of the shoe changing support assembly 100 is illustrated. In this example, the support portion 104 is illustrated. The support portion 104 can be coupled to the body portion 102. By being coupled, it will be appreciated that the body portion 102 and the support portion 104 can be one piece formed. In the illustrated example, the body portion 102 and the support portion 104 may be formed as a single piece structure, such as by being made of plastic, a composite material, or the like, which may include polytetrafluoroethylene (e.g., Teflon). The shoe changing support assembly 100, comprising the body portion 102 and the support portion 104, may be vacuum formed and ultraviolet resistant.

In other examples, the support portion 104 can be coupled to the body portion 102 by being attached to the body portion 102. For example, the body portion 102 and the support portion 104 can be attached with mechanical fasteners (e.g., screws, nails, bolts, etc.), adhesives (e.g., glue, epoxy, etc.), welding, interlocking or snap fit structures, etc. In these examples, the body portion 102 and the support portion 104 can comprise separate structures that may be coupled together to form the shoe changing support assembly 100.

The support portion 104 comprises a first lateral support structure 200 extending along a first axis 202. The first lateral support structure 200 can extend from a rear surface 204 of the body portion 102. In this example, the first lateral support structure 200 can extend along the first perimeter edge 110 of the body portion 102. In the illustrated example, the first lateral support structure 200 has a first lateral support width 206 (e.g., as measured along a direction that is substantially perpendicular to the first axis 202) that is substantially constant along the first axis 202.

The support portion 104 comprises a second lateral support structure 208 extending along a second axis 210. The second lateral support structure 208 can extend from the rear surface 204 of the body portion 102. In this example, the second lateral support structure 208 can extend along the second perimeter edge 112 of the body portion 102. In the illustrated example, the second lateral support structure 208 has a second lateral support width 211 (e.g., as measured along a direction that is substantially perpendicular to the second axis 210) that is substantially constant along the second axis 210. In this example, the second lateral support structure 208 is spaced a distance 212 apart from the first lateral support structure 200.

The support portion 104 comprises a transverse support structure 220 that extends along a transverse axis 222. In an example, the transverse axis 222 is substantially perpendicular to the first axis 202 and the second axis 210. The transverse support structure 220 can extend between the first lateral support structure 200 and the second lateral support structure 208. For example, the transverse support structure 220 can be coupled to the first lateral support structure 200 and the second lateral support structure 208. By being coupled, the transverse support structure 220, the first lateral support structure 200 and the second lateral support structure 208 can be one piece formed, such as by being formed as a single piece structure (e.g., plastic, a composite material, or the like). In another example, the transverse support structure 220 can be separately attached to the first lateral support structure 200 and the second lateral support structure 208, such as with mechanical fasteners (e.g., screws, nails, bolts, etc.), adhesives (e.g., glue, epoxy, etc.), welding, interlocking or snap fit structures, etc. In these examples, the transverse support structure 220, the first lateral support structure 200 and the second lateral support structure 208 can comprise separate structures that may be coupled together to form the shoe changing support assembly 100.

In an example, the transverse support structure 220 can have a non-constant width (e.g., as measured in a direction that is substantially perpendicular to the transverse axis 222) along the transverse axis 222. For example, the transverse support structure 220 can have a first width 224 at a first location 226. The transverse support structure 220 can have a second width 230 at a second location 232. The transverse support structure 220 can have a third width 234 at a third location 236. In an example, the second width 230 may be less than the first width 224 and/or the third width 234.

The transverse support structure 220 can have an hourglass shape in which a middle portion (e.g., at the second location 232) has a smaller width (e.g., the second width 230) than widths (e.g., the first width 224 and the third width 234) at the end portions (e.g., at the first location 226 and the third location 236). In this way, the transverse support structure 220 can rest upon and contact a surface (e.g., a floor, the ground, etc.) while supporting the shoe changing support assembly 100 and a user who may be standing upon the support surface 106 of the body portion 102. The non-constant width can allow for the transverse support structure 220 to have a lighter weight and a reduction in material used as compared to if the transverse support structure 220 had a constant width substantially equal to the first width 224 or the third width 234. While being both lighter and reducing material, the transverse support structure 220 may still support the shoe changing support assembly 100 and the user who stands upon the support surface 106.

The support portion 104 comprises a second transverse support structure 240 that extends along a second transverse axis 242. In an example, the second transverse axis 242 is substantially perpendicular to the first axis 202 and the second axis 210. The second transverse axis 242 may be substantially parallel to the transverse axis 222. The second transverse support structure 240 can extend between the first lateral support structure 200 and the second lateral support structure 208. For example, the second transverse support structure 240 can be coupled to the first lateral support structure 200 and the second lateral support structure 208. By being coupled, the second transverse support structure 240, the first lateral support structure 200 and the second lateral support structure 208 can be one piece formed, such as by being formed as a single piece structure (e.g., plastic, a composite material, or the like). In another example, the second transverse support structure 240 can be separately attached to the first lateral support structure 200 and the second lateral support structure 208, such as with mechanical fasteners (e.g., screws, nails, bolts, etc.), adhesives (e.g., glue, epoxy, etc.), welding, interlocking or snap fit structures, etc. In these examples, the second transverse support structure 240, the first lateral support structure 200 and the second lateral support structure 208 can comprise separate structures that may be coupled together to form the shoe changing support assembly 100.

In an example, the second transverse support structure 240 can have a non-constant width (e.g., as measured in a direction that is substantially perpendicular to the second transverse axis 242) along the second transverse axis 242. For example, the second transverse support structure 240 can have a fourth width 244 at a fourth location 246. The second transverse support structure 240 can have a fifth width 250 at a fifth location 252. The second transverse support structure 240 can have a sixth width 254 at a sixth location 256. In an example, the fifth width 250 may be less than the fourth width 244 and/or the sixth width 254.

The second transverse support structure 240 can have an hourglass shape in which a middle portion (e.g., at the fifth location 252) has a smaller width (e.g., the fifth width 250) than widths (e.g., the fourth width 244 and the sixth width 254) at the end portions (e.g., at the fourth location 246 and the sixth location 256). In this way, the second transverse support structure 240 can rest upon and contact a surface (e.g., a floor, the ground, etc.) while supporting the shoe changing support assembly 100 and a user who may be standing upon the support surface 106 of the body portion 102. The non-constant width can allow for the second transverse support structure 240 to have a lighter weight and a reduction in material used as compared to if the second transverse support structure 240 had a constant width substantially equal to the fourth width 244 or the sixth width 254. While being both lighter and reducing material, the second transverse support structure 240 may still support the shoe changing support assembly 100 and the user who stands upon the support surface 106.

The transverse support structure 220 and the second transverse support structure 240 can be spaced a separating distance 260 apart to define a separating opening 262. In this example, the separating opening 262 is defined between the transverse support structure 220, the second transverse support structure 240, the first lateral support structure 200, and the second lateral support structure 208. In an example, when the shoe changing support assembly 100 is supported on a surface (e.g., the ground, a floor, etc.), the rear surface 204 may define the top of the separating opening 262 while the surface (e.g., the ground, a floor, etc.) may define the bottom of the separating opening 262. The separating opening 262 can have a non-rectangular shape due to the curvature of the transverse support structure 220 and the second transverse support structure 240. In an example, the separating distance 260, as measured between the second location 232 and the fifth location 252, may be between about 15 centimeters to about 23 centimeters. In another example, the separating distance 260 may be between about 17.5 centimeters to about 20.5 centimeters.

In an example, the second transverse support structure 240 can be spaced a second separating distance 264 from the shoe removal opening 120. For example, the fifth location 252 of the second transverse support structure 240 can be spaced the second separating distance 264 from the intersection point 126 of the shoe removal opening 120. In an example, the second separating distance 264 may be between about 2.5 centimeters to about 7.5 centimeters. In this example, the second transverse support structure 240, the first lateral support structure 200 and the second lateral support structure 208 can define a second separating opening 266. In an example, when the shoe changing support assembly 100 is supported on a surface (e.g., the ground, a floor, etc.), the rear surface 204 may define the top of the second separating opening 266 while the surface (e.g., the ground, a floor, etc.) may define the bottom of the second separating opening 266.

The transverse support structure 220 can be spaced a third separating distance 270 from the handle 130. In this example, a third separating opening 272 is defined between the transverse support structure 220, the first lateral support structure 200, and the second lateral support structure 208. In an example, when the shoe changing support assembly 100 is supported on a surface (e.g., the ground, a floor, etc.), the rear surface 204 may define the top of the third separating opening 272 while the surface (e.g., the ground, a floor, etc.) may define the bottom of the third separating opening 272. The third separating opening 272 can have a non-rectangular shape due to the curvature of the transverse support structure 220. In an example, the third separating distance 270, as measured between the transverse support structure 220 and the handle 130, may be between about 2.5 centimeters to about 7.5 centimeters.

Figure 3:
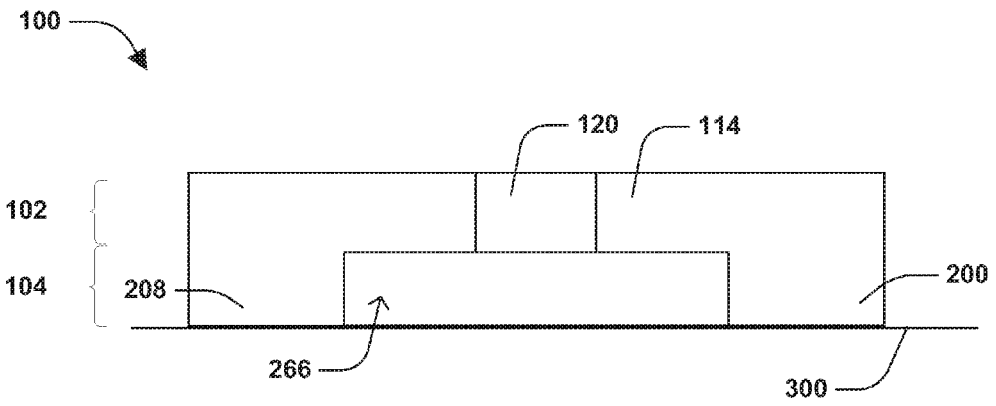
FIG. 3 is an illustration of an end of an example shoe changing support assembly.

Turning to FIG. 3, an end view of the shoe changing support assembly 100 is illustrated as viewed from the perspective indicated by lines 3-3 of FIG. 2. As illustrated in this example, the shoe changing support assembly 100 can be supported on a surface 300 (e.g., the ground, a floor, etc.). The body portion 102 can be located at an upper portion of the shoe changing support assembly 100 while the support portion 104 can be located at a lower portion of the shoe changing support assembly 100. The second separating opening 266 can be located underneath the shoe removal opening 120. As such, the user can insert a portion of his shoe into the shoe removal opening 120 and/or into the second separating opening 266. By contacting the shoe with the first sidewall 122, the second sidewall 124 and/or the intersection point 126 defining the shoe removal opening 120, the shoe changing support assembly 100 can facilitate removal of the user's shoe.

Figure 4:
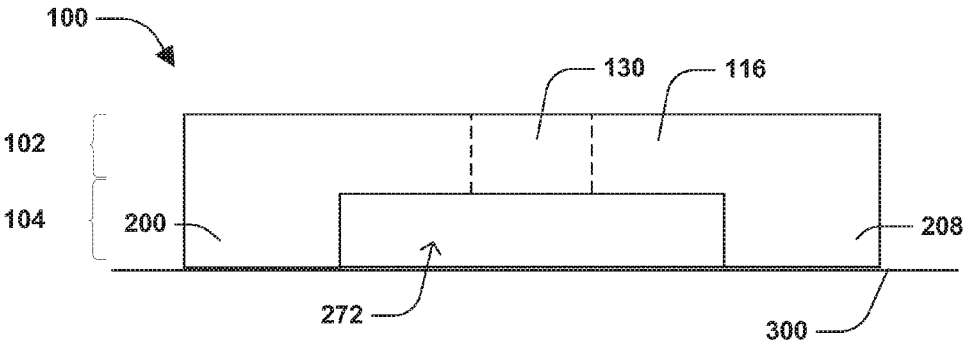
FIG. 4 is an illustration of an end of an example shoe changing support assembly.

Turning to FIG. 4, an end view of the shoe changing support assembly 100 is illustrated as viewed from the perspective indicated by lines 4-4 of FIG. 2. As illustrated in this example, the handle 130 can be positioned above the third separating opening 272. As such, the user can reach his/her hand through the handle 130 and into the third separating opening 272, thus allowing for the user to hold and move the shoe changing support assembly 100.

Figure 5:
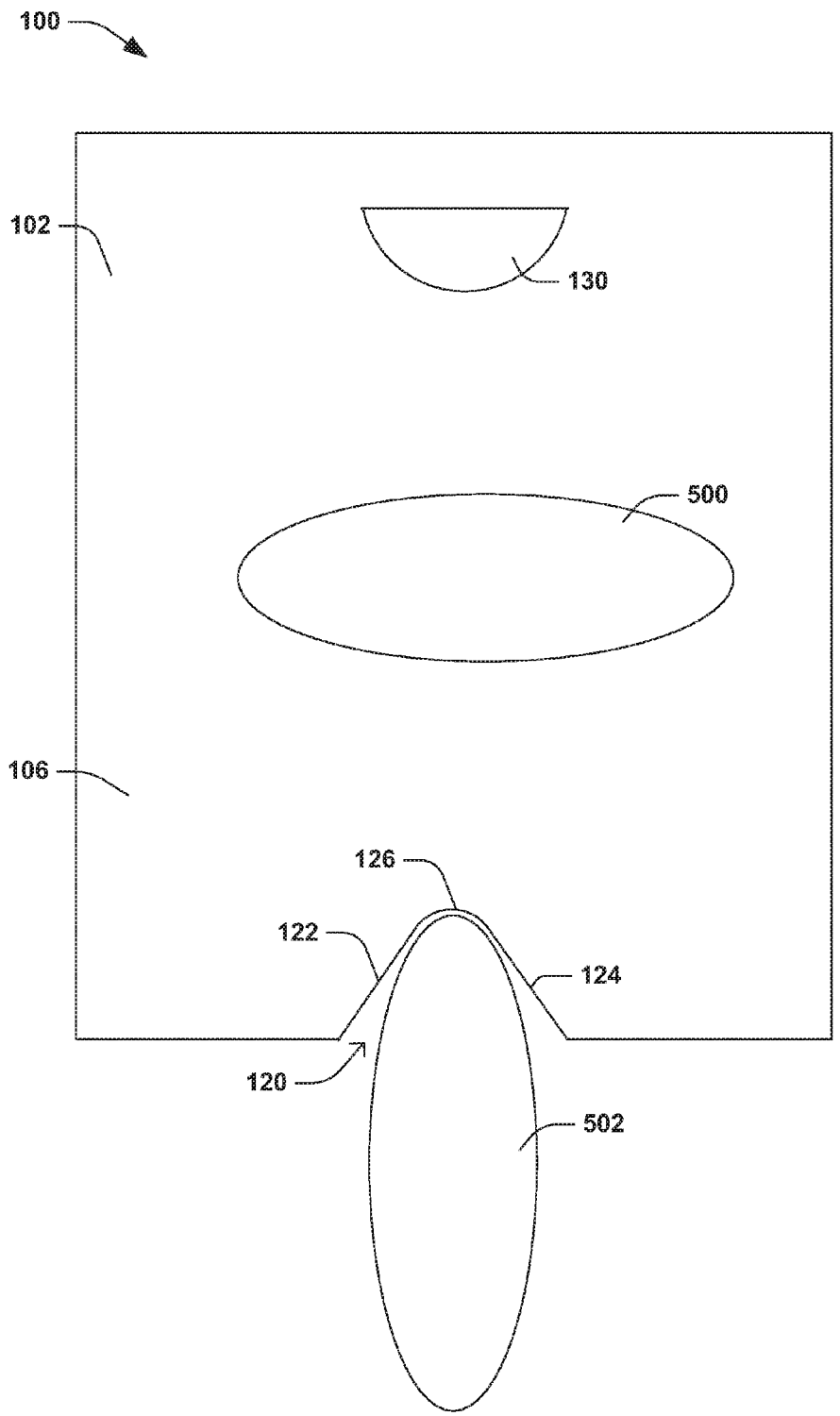
FIG. 5 is an illustration of an example shoe changing support assembly.

Turning to FIG. 5, a top down view of the shoe changing support assembly 100 is illustrated. In this example, the user can place his/her feet on the support surface 106 of the body portion 102. In an example, the user may have wet/dirty shoes. The user may step onto the support surface 106 of the body portion 102 with a first foot 500, in which a shoe may first be removed from the first foot 500 before stepping onto the support surface 106. The user may position a second foot 502 within the shoe removal opening 120. The user may cause the shoe on the second foot 502 to contact the first sidewall 122, the second sidewall 124, and/or the intersection point 126. By lifting up the second foot 502, the user can cause the shoe to be removed from the second foot 502. In this way, the dirt, mud, liquid, etc. located on the shoe of the first foot 500 may not reach the support surface 106, such that the user may keep his/her socks/feet clean. Once the shoe on the second foot 502 is removed, the user can avoid standing on the dirty ground so as to ensure that his/her socks/feet remain clean. It will be appreciated that shoe changing support assembly 100 comprises any number of sizes. In a possible example, the shoe changing support assembly 100 has a length that is between about 20 inches to about 28 inches, a width that is between about 16 inches to about 20 inches, and a height that is between about 1 inch to about 3 inches.

Figure 6:
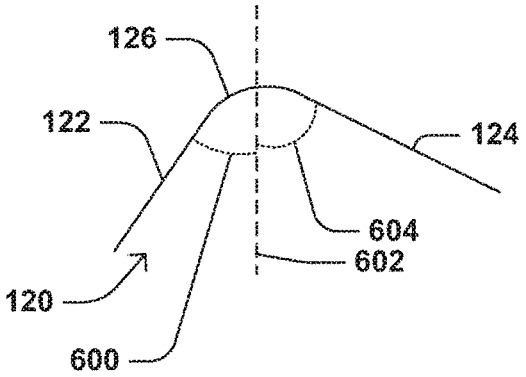
FIG. 6 is an illustration of an example shoe changing support assembly.

It will be appreciated that the shoe changing support assembly 100 comprises a number of different embodiments and may have any number of different configurations. In one example, as illustrated in FIG. 6, the shoe removal opening 120 can have a different size/shape than as illustrated in FIG. 1. For example, the first sidewall 122 can define a first angle 600 with an axis 602 that intersects the shoe removal opening 120. The second sidewall 124 can define a second angle 604 with the axis 602. In this example, in contrast to the example illustrated in FIG. 1, the first angle 600 and the second angle 604 may be different. For example, the first angle 600 may be less than the second angle 604. Such a design is beneficial for a number of reasons. For example, the shoe removal opening 120 can have the first angle 600 and the second angle 604 as illustrated in FIG. 6 so as to accommodate for the removal of a left shoe or a right shoe. In such an example, a second shoe removal opening may be provided, but with the first angle 600 greater than the second angle 604. As such, one shoe removal opening can more easily facilitate removal of one shoe (e.g., the right shoe) while the other shoe removal opening can more easily facilitate removal of the other shoe (e.g., the left shoe).

In yet another example, the first sidewall 122 and the second sidewall 124 are not limited to comprising a rigid material. Rather, in an example, the first sidewall 122 and the second sidewall 124 can comprise a pliable/flexible material that allows for at least some degree of flexion, give, compression, etc. Such a design is beneficial in that the first sidewall 122 and the second sidewall 124 can achieve a stronger grip (e.g., with a higher coefficient of friction) with the user's shoe. Likewise, the pliable/flexible/compressible material forming the first sidewall 122 and the second sidewall 124 can be more comfortable to the user's foot and may be less abrasive to the user's shoe. Such a design can also allow for accommodating a greater range of shoe sizes.

In another example, the first sidewall 122 and the second sidewall 124 can be attached to the body portion 102 with a swivel. For example, the first sidewall 122 and/or the second sidewall 124 can pivot, swivel, move, etc. so as to accommodate the user's right shoe or left shoe.

In another example, the axis 602 is not limited to extending substantially parallel to a direction along which the first perimeter edge 110 and the second perimeter edge 112 extend. For example, the axis 602 can be angled with respect to the first perimeter edge 110 and the second perimeter edge 112, such that the axis 602 can be at an angle (e.g., non-perpendicular) with respect to the third perimeter edge 114. In such an example, the first sidewall 122 and the second sidewall 124 can form the first angle 600 and the second angle 604 that are substantially the same. However, the shoe removal opening 120 may be angled (e.g., non-perpendicular) with respect to the third perimeter edge 114.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing at least some of the claims.

Various operations of embodiments are provided herein. The order in which some or all of the operations described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first location and a second location correspond to location A and location B or two different or two identical locations or the same location.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are to be construed to mean "one or more" unless specified otherwise or clear from context to be directed to a singular form. Also, at least one of A and B or the like means A or B or both A and B. Furthermore, to the extent that "includes", "having", "has", "with", or variants thereof are used in either the detailed description or the claims, such terms are intended to be inclusive in a manner similar to "comprising".

Also, although the disclosure has been illustrated and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A shoe changing support assembly comprising:

a body portion defining:

a substantially planar support surface that is substantially parallel to a surface upon which the shoe changing support assembly is supported, the support surface configured to support a user, the support surface having a first perimeter edge, a second perimeter edge, a third perimeter edge, and a fourth perimeter edge, the first perimeter edge substantially parallel to the second perimeter edge, the third perimeter edge substantially parallel to the fourth perimeter edge;

a shoe removal opening defined along the third perimeter edge of the body portion at a midpoint of the third perimeter edge, the shoe removal opening recessed towards a center of the body portion along an axis, the body portion configured to receive a portion of a shoe within the shoe removal opening to facilitate shoe removal; and a support portion coupled to the body portion, the support portion comprising:

a first lateral support structure extending along a first axis that is substantially parallel to the axis adjacent to the first perimeter edge of the body portion;

a second lateral support structure spaced a distance apart from the first lateral support structure and extending along a second axis that is substantially parallel to and offset from the first axis adjacent to the second perimeter edge of the body portion;

a transverse support structure extending along a transverse axis that is substantially perpendicular to the axis, the first axis and the second axis, the transverse support structure extending between the first lateral support structure and the second lateral support structure, the transverse support structure coupled to the first lateral support structure and the second lateral support structure, the transverse support structure spaced a distance inward from the fourth perimeter edge, wherein the first lateral support structure, the second lateral support structure, and the transverse support structure defining a third separating opening that is unbounded opposite the transverse support structure; and a second transverse support structure extending along a second transverse axis that is substantially parallel to the transverse axis, the second transverse support structure extending between the first lateral support structure and the second lateral support structure, the second transverse support structure coupled to the first lateral support structure and the second lateral support structure, the second transverse support structure spaced a separating distance from the transverse support structure such that the first lateral support structure, the second lateral support structure, the transverse support structure, and the second transverse support structure define a separating opening, the second transverse support structure spaced a distance inward from the third perimeter edge, wherein the first lateral support structure, the second lateral support structure, and the second transverse support structure defining a second separating opening that is unbounded opposite the second transverse support structure, the second separating opening and the third separating opening located on opposite sides of the separating opening;

wherein the first lateral support structure, the second lateral support structure, the transverse support structure, and the second transverse support structure are configured to be in contact with the surface upon which the shoe changing support assembly is supported.

2. The shoe changing support assembly of claim 1, the second transverse support structure having a fourth width at a fourth location and a fifth width at a fifth location, the fourth width different than the fifth width.

3. The shoe changing support assembly of claim 2, wherein the fifth width is less than the fourth width.

4. The shoe changing support assembly of claim 3, the transverse support structure spaced a second separating distance from the shoe removal opening along the axis, the second separating distance less than the separating distance, the axis intersecting the fifth location and an intersection point of the shoe removal opening defined by an intersection of a first sidewall and a second sidewall of the shoe removal opening.

5. The shoe changing support assembly of claim 1, the support surface defining an opening between the fourth perimeter edge and the transverse support structure, the opening spaced equidistant from the first lateral support structure and the second lateral support structure.

6. The shoe changing support assembly of claim 1, the shoe removal opening having a triangular shape.

7. The shoe changing support assembly of claim 6, the shoe removal opening at least partially defined by a first sidewall that is substantially planar.

8. The shoe changing support assembly of claim 7, the shoe removal opening at least partially defined by a second sidewall that is substantially planar.

9. The shoe changing support assembly of claim 8, the first sidewall non-parallel with respect to the second sidewall.

10. The shoe changing support assembly of claim 1, the support surface comprising a handle that defines an opening through the support surface.

11. The shoe changing support assembly of claim 10, the handle comprising a half-circular shape.

12. The shoe changing support assembly of claim 10, the handle disposed at an opposite end of the support surface from the shoe removal opening.

13. The shoe changing support assembly of claim 1, the body portion and the support portion comprising a non-metal material.

14. The shoe changing support assembly of claim 13, the body portion and the support portion comprising a plastic material.

15. The shoe changing support assembly of claim 1, the support portion configured to contact the surface upon which the shoe changing support assembly is supported such that the support portion is disposed between the body portion and the surface.

16. The shoe changing support assembly of claim 1, wherein the first perimeter edge is perpendicular to the third perimeter edge.

17. The shoe changing support assembly of claim 16, wherein the first perimeter edge is perpendicular to the fourth perimeter edge.

18. The shoe changing support assembly of claim 1, wherein the second perimeter edge is perpendicular to the third perimeter edge.

19. The shoe changing support assembly of claim 18, wherein the second perimeter edge is perpendicular to the fourth perimeter edge.

20. The shoe changing support assembly of claim 1, wherein the body portion and the support portion are configured to be one piece formed.

* * * * *